United States Patent [19]

Rodriguez et al.

[11] Patent Number: 4,940,188

[45] Date of Patent: Jul. 10, 1990

[54] TIP HOLDER FOR MINERAL BREAKER

[76] Inventors: John Rodriguez; Damian Rodriguez, both of 135 Lindberg Ave., Ste. A, Livermore, Calif. 94550

[21] Appl. No.: 137,953

[22] Filed: Dec. 24, 1987

[51] Int. Cl.[5] ..... B02C 19/00

[52] U.S. Cl. ..... 241/275

[58] Field of Search ..... 241/275, 300; 51/435, 51/436

[56] References Cited

U.S. PATENT DOCUMENTS

| | | | |
|---|---|---|---|
| 1,108,542 | 8/1914 | Anderson . | |
| 2,392,958 | 7/1943 | Tice | 241/55 |
| 2,752,098 | 6/1956 | Adams | 241/197 |
| 3,162,386 | 12/1964 | Danyluke | 241/275 |
| 3,174,697 | 3/1965 | Bridgewater | 241/275 |
| 3,334,823 | 8/1967 | Behnke | 241/275 |
| 3,346,203 | 10/1967 | Danyluke | 241/275 |
| 3,838,826 | 10/1974 | Wallace et al. | 241/197 |
| 3,970,257 | 7/1976 | MacDonald et al. | 241/275 |
| 4,307,845 | 12/1981 | Larimer et al. | 241/191 |
| 4,577,806 | 3/1986 | Terrenzio | 241/275 |
| 4,586,663 | 5/1986 | Bartley | 241/275 X |

FOREIGN PATENT DOCUMENTS

| | | | |
|---|---|---|---|
| 187252 | 7/1986 | European Pat. Off. | 241/275 |

*Primary Examiner*—Mark Rosenbaum

*Attorney, Agent, or Firm*—Kathleen A. Skinner

[57] ABSTRACT

A tip holder for the rotor of a centrifugal mineral breaker with a mounting member portion and a step with a mineral anchoring portion capable of retaining a bank of mineral material in which the minerals may have a diameter of up to 100 mm. The step also has one or more recesses formed longitudinally through the step and an insert of abrasion resistant material inserted in each recess. The width of a material retaining surface of said step is approximately equal to or greater than the depth of the insert of abrasion resistant material. A plurality of longitudinally disposed parallel inserts can be placed in the tip holder to maximize its resistance to specific mineral conditions.

31 Claims, 6 Drawing Sheets

TIP HOLDER FOR MINERAL BREAKER

BACKGROUND OF THE INVENTION

1. Field of the Invention

The present invention relates to the field of mineral breakers and, more particularly, to the replaceable tip holders for rotors in centrifugal mineral breakers.

2. Description of the Prior Art

Centrifugal mineral breakers, such as that described in U.S. Letters Pat. No. 3,970,257, have provided the rock crushing industry with an efficient and remarkably effective alternative to the large and capital-intensive rock crushing apparatus previously used. The principle of such vertical shaft impacters is that mineral material fed axially into a rotor is flung outwardly at high speed into a housing surrounding the rotor. Due to the particular configuration of nonradial blades of the rotor housing, the material first ejected is retained and used as a rock lining to protect the walls and other parts of the rotor. Thus the breakdown of the rock is caused in great part by the forces of the rock impacting other rock rather than the parts of the machine.

Most of the parts in such a rotary mineral breaker are adequately protected from wear by the rock lining, except the surfaces located near the discharge ports, which face erosion from the passage of the mineral material on its discharge route from the rotor. Replaceable tip plates with inserts of wear-resistant material, such as tungsten carbide, in the tips have been used near these ports to address this problem. Backup plates with tungsten tips have also been used to protect the rotor in the event that the outer tip plates start to fail and the damage goes unnoticed or uncorrected until the tip plate has completely deterioriated. The tip plates have been found to frequently wear more extensively in the center section, which resulted in discarding the unused portions of the tungsten carbide located at the outer edges. Since tungsten carbide inserts are relatively expensive, the practice of splitting the outer tip plates into two "split tips", which could be interchanged rather than replaced, was developed and is described in U.S. Letters Pat. No. 4,586,663.

However, even these advances in the prior art do not solve all the problems of tip wear, since the stresses and deteriorating forces on these tips during operation of a vertical shaft impacter are extreme. First of all, the tip and tip plate must withstand constant abrasion of the rocks passing over the tip, and although the abrasion-resistant insert material can resist this erosion, over time the surrounding metal holder which supports the tungsten carbide in place cannot.

There is also a problem with slip streaming, which occurs when fine material, such as sand, begins to pass through joints or cracks in the tip plate and wears away the surrounding material. Since the conventional tip plate has a rectangular groove which holds a series of rectangular tungsten inserts, rather than one piece, there are numerous joints where slip streaming can occur, such as between the tungsten and the metal, between the tungsten inserts themselves, and between the split tip plates. Applicants are aware of one person's attempt to strengthen the resistance of the tip holder and increase its life by affixing numerous, relatively large cylindrical tungsten carbide inserts together in the abrasion-receiving end of the tip holder with an adhesive matrix, the tungsten inserts being disposed so that the cylindrical ends faced the rock flow and the wear.

Despite the costliness of a tip holder with such a large quantity of tungsten, the tip did not wear well and failed because of slip streaming. Thus, the increased use of tungsten in the tip holder, by itself, has not solved the problems of tip wear.

Although the tungsten carbide inserts in the tips resist abrasion, they are vulnerable to impact and they may crack or chip when struck by tramp metal or other non-crushable material found in most mineral feeds. When tungsten carbide is struck by such tramp material, the crack can extend through its entire depth in the holder. Once there is a crack, the integrity of the tungsten is compromised and it is not as resistant to abrasion and slip streaming and ultimately, the tungsten pieces can even fall out of the holder.

Obviously, it is desirable to replace a damaged tip plate as soon after such a failure as possible, so that the backup tip and the parts of the rotor are not damaged as well. Moreover, when one tip is damaged by a component of the mineral feed, the others will frequently fail shortly thereafter from the same cause. Although the tip holder is replaceable, it is usually an effort to do so, since the bolt anchoring the tip holder to the backup plate of the rotor frequently becomes stripped and the rock bank must be chipped away to allow the necessary tools to be inserted to hold the bolt head. It can be appreciated that since replacing tips results in an interruption of the work cycle and may involve substantial down time, the procedure is desirably delayed until the end of a shift. But if such maintenance is deferred too long, the entire tip will be deteriorated and the rock flow will begin to wear away the backup tip, thereby increasing the expense of replacement and the risk of damage to the rotor as well. Thus, there is a need in the prior art for a tip holder which will provide wear and impact resistance at the point where protection is needed the most and one which will provide for controlled deterioration once damage has occurred. There is also a need to reduce the down time required for changing the tips and to reduce the weight of the part without decreasing its strength.

In rotary mineral breakers of this type it is necessary to adjust the configuration of the bank of rock material lining the interior wall, called the rock wave, to ensure that the parts of the rotor, including the tip holder, are adequately protected. Since the build up of the material and the wear pattern on the tip differ for different kinds of feeds and varying conditions of the rotor, regular rotor tune-up is required, and generally, the trail plates, which are vertical nonradial plates in the rotor, have to be adjusted to accommodate changes in the feed. A frequent problem resulting from an incorrect rock wave pattern is the deterioration of the uncovered portion of the tip holder contacted by the rock before it passes over the tungsten carbide. There is thus a need for a tip holder which can be designed to respond to different mineral types and sizes.

In addition, prior art tip holders limit the size and tonnage of minerals which can be processed in rotary mineral breakers of this type. Coarser materials have typically caused premature failure of the standard tip plate because of the tip holder's inability to resist wear and impact and to retain larger size rocks in the rock lining of the rotor. Thus, there is a need for a tip holder having long life which can be used successfully with coarser materials, as with well as smaller, finer ones and one which can withstand the bending forces of a high tonnage operation.

Accordingly, there is a need for a tip holder which can withstand centrifugal and bending forces and remain in a secured position, yet be easily removable when necessary. There is a need for a tip holder which can resist wear and in which any damage caused by impact forces can be controlled to prevent total part failure. Most importantly, there is a need in the state of the art for a tip holder which can be used effectively for an extended time without requiring replacement and the resulting down time. There is also a need for a tip holder which can be designed to meet the requirements of different mineral feeds without the need for critical adjustments of the other parts of the rotor and one which will allow larger, coarser minerals to be processed by the rotor.

The present invention provides a tip holder which meets these needs and is a solution to these problems of the prior art. The present invention provides a part which has quadrupled the life of a conventional part and one in which deterioration of the part is controlled and the part retains structural integrity, even if normal consumption occurs. The tip holder of this invention fully utilizes the costly tungsten tips in the part before failure; it is also lighter weight and easier to replace. In addition, the tip holder of the present invention can be adapted for use with a wide variety of mineral feeds and can be used with larger, coarser minerals and with higher tonnage throughputs than rotary mineral breakers of this type customarily process.

SUMMARY OF THE INVENTION

The present invention is an improved tip holder for the rotor of a centrifugal mineral breaker which has a mounting member portion for securing the tip to a portion of the rotor and a step connected to the mounting member. The step has at least one recess for receiving inserts of abrasion resistant material and it has a flange depending from the step which is shaped to protect the portion of the rotor which underlies it. A mineral anchoring portion of the step is capable of retaining and stabilizing a bank of mineral material including minerals having a diameter of up to 100 mm. in the rock wave lining the interior walls of the rotor so that the tip receives protection from the passing rock stream and adjustment of the trail plates to affect tuning of the rotor is less critical to the optimum life of the parts and the performance of the rotor. The width of the material retaining surface of the step is approximately equal to or greater than the depth of the wear resistant insert closest to the top surface of the step. In another embodiment of the invention, a plurality of parallel recesses, disposed longitudinally through the step, are provided for inserts, preferably in circular form, of wear resistant material so that if there is some cracking of the tungsten, it is held in place by the shape of the recess. The invention also includes a method of predetermining the location and sizes of the wear resistant inserts so that the abrasion resistance of the tip holder can be tailored to the mineral feed pattern to which the rotor is subjected.

OBJECTS OF THE INVENTION

It is therefore an important object of the present invention to provide a tip holder which will provide extended wear before replacement is necessary and which can be used with even relatively large, coarse material without failure.

It is another object of the present invention to provide a tip holder which is lighter weight and easier to install and remove.

It is a further object of the present invention to provide a tip holder which can survive impact from non-crushable components of the mineral feed and in which there is a gradual unveiling of the tungsten inserts so that failure is controlled.

It is yet another object of the present invention to provide a tip holder which simplifies rotor tuning and which can be custom designed for use with specific mineral types and sizes.

It is yet a further object of the present invention to provide a tip holder which avoids wastage of tungsten carbide and which directs the flow of material from the discharge ports of the rotor to protect the outer rotor surfaces.

Other objects and advantages of the invention will become apparent when it is considered in conjunction with the accompanying drawings described hereafter.

DESCRIPTION OF THE PREFERRED EMBODIMENTS

Figure 11:
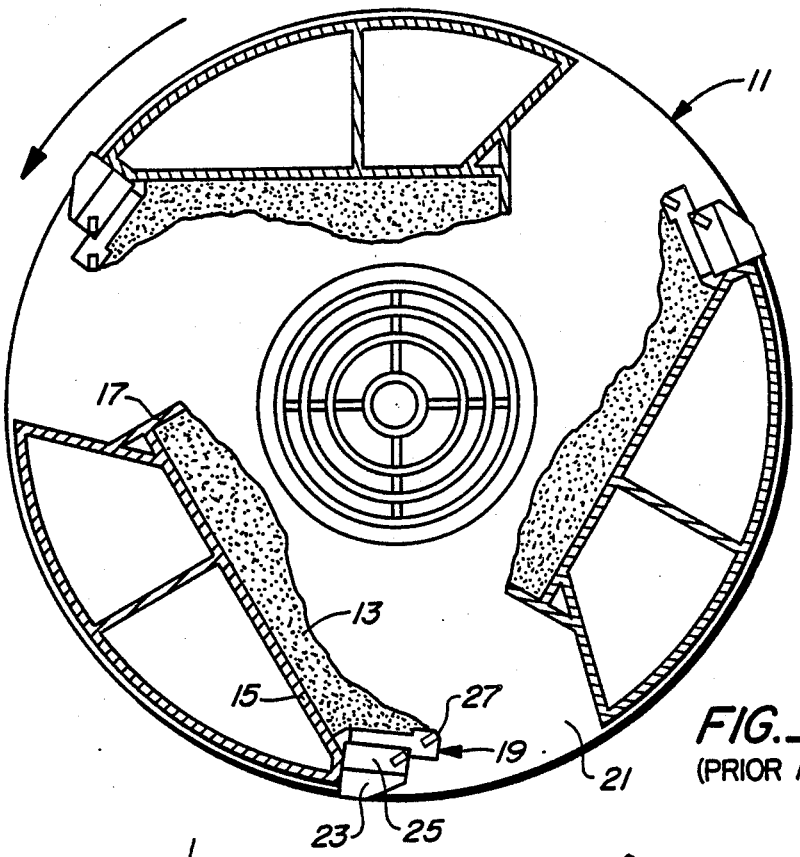
FIG. 11. (PRIOR ART)
FIG. 11 is a top plan view in outline form of a rotor showing a conventional tip assembly and a bank of mineral material protecting the non-radial walls of the rotor.

The present invention is an improved tip holder for the rotor of a centrifugal mineral breaker of the general type described in U.S. Pat. No. 3,970,257, but it may be used in any mineral breaker requiring tip plates. In this type of mineral breaker, rocks or mineral material are fed axially to a rotor with a vertical axis. The stones are flung at high speed from a central distributor of the rotor into the housing which is constructed to hold some of the material so that the material itself lines the interior surfaces of the rotor and protects the parts of the rotor from wear. As subsequent material is flung out from the distributor, it contacts the retained rock wave, rather than the walls of the rotor, and thus accelerates the grinding of the retained material as well as its own breakdown, and prevents the wear on the rotor structure. Since the rotor rotates at speeds up to 3000 rpm, and rocks are in constant motion, it can be seen that there are tremendous forces to which the rotor is subjected. As seen in FIG. 11, which shows a general outline of a typical rotor 11, a bank of material 13 is formed against non-radial vertical plates 15 and 17. In the prior art rotary mineral breakers, trail plates 17 control the build-up of the rock and must be adjusted for different mineral feeds and other variations of rotor operation.

Tip plates or tip holders 19, located at the other end of the rock wave and near the discharge ports 21 of the rotor 11, also affect the build-up of the material. Material exits the rotor with considerable speed, in the range of 300 ft./sec. and, since all of it passes over the outer surface of the tip plate, this part is subjected to a great deal of wear and needs to be replaced regularly. The tip plate is mounted to a portion of the rotor. It may be attached directly to a tip carrier plate 23, but usually a backup tip plate 25 is inserted between the tip holder and the tip carrier plate to provide extra protection for the rotor in the event of sudden failure of the tip plate.

Since the tip of the tip plate 19 is subjected to so much wear, it is conventionally provided with an insert 27 of wear resistant material. In the tips of the prior art, a number of rectangular inserts, commonly of tungsten carbide, are fitted in series into a rectangular groove opening onto the outer edge of the top surface of the tip holder. It was found that the wear pattern on the tips was frequently uneven, with the greatest wear occurring near the center of the tip, which resulted in unused pieces of relatively expensive tungsten remaining in the ends of the groove of the worn plates. Thus the tip plates were "split" into two sections which could be tack welded together and then interchanged when this wear pattern had occurred. U.S. Pat. No. 4,586,663 discusses the advantages of split tips. The use of split tips, however, does not eliminate the problem of failure due to impact from noncrushable tramp material or to slip streaming and the resulting downtime required to change the tips.

Figure 1:
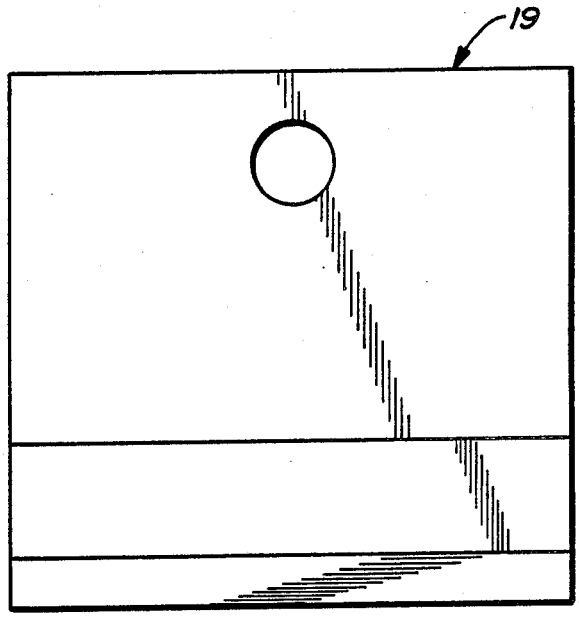
FIG. 1. (PRIOR ART)
FIG. 1 is a top plan view of a prior art tip holder with tip.
Figure 3:
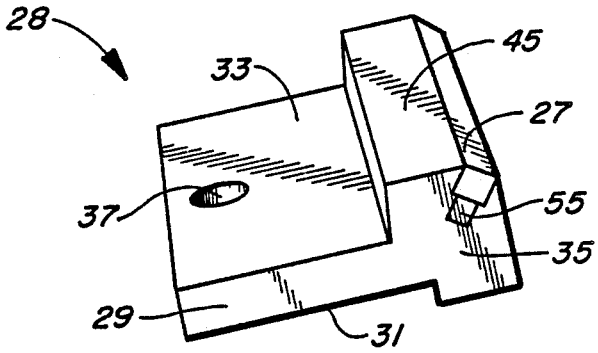
FIG. 3 is a perspective view of one embodiment of the tip holder of this invention.
Figure 4:
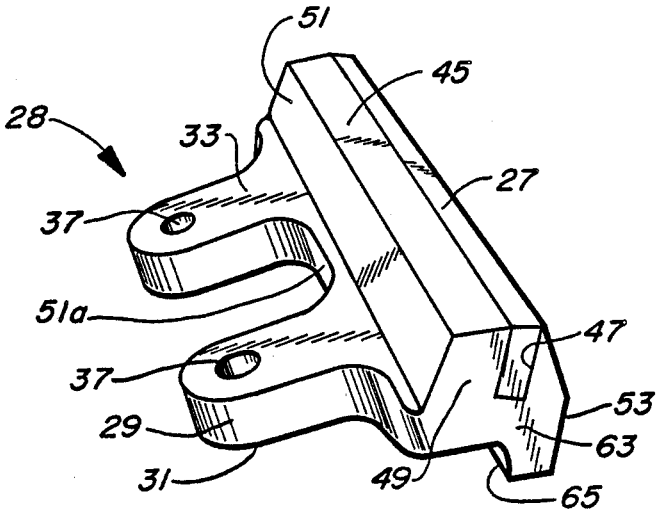
FIG. 4 is another embodiment of the tip holder of this invention.
Figure 1A:
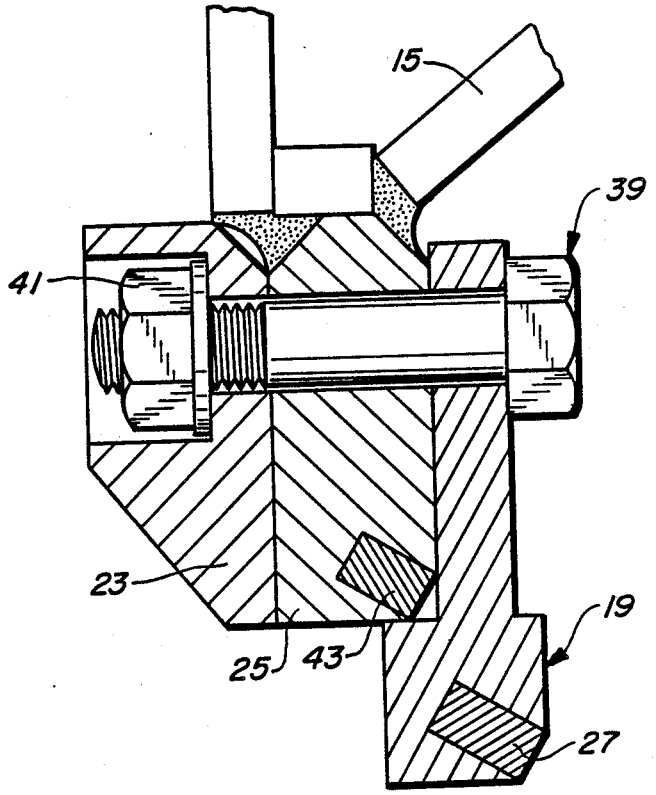
FIG. 1A. (PRIOR ART)
FIG. 1A is a cross-sectional view of the prior art tip holder of FIG. 1.
Figure 2:
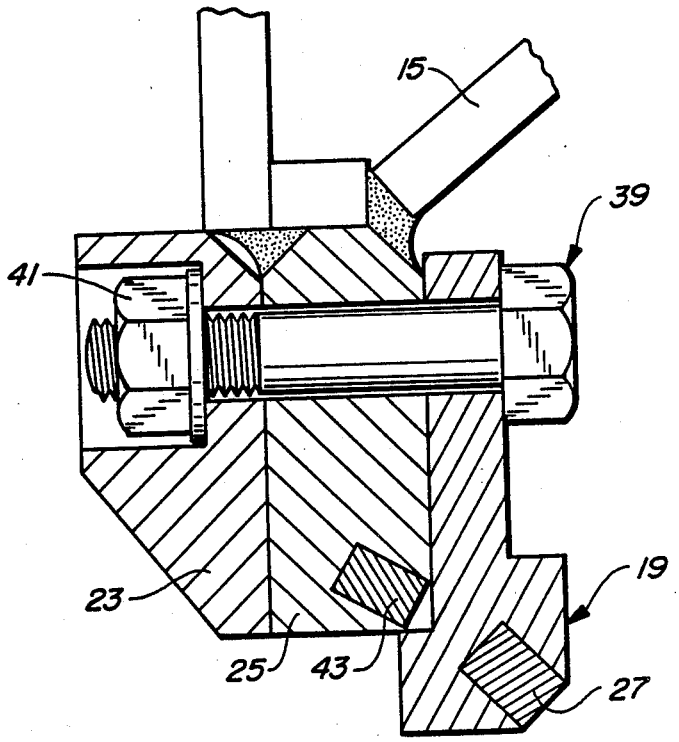
FIG. 2. (PRIOR ART)
FIG. 2 is a cross-sectional view of another prior art tip holder.
Figure 5:
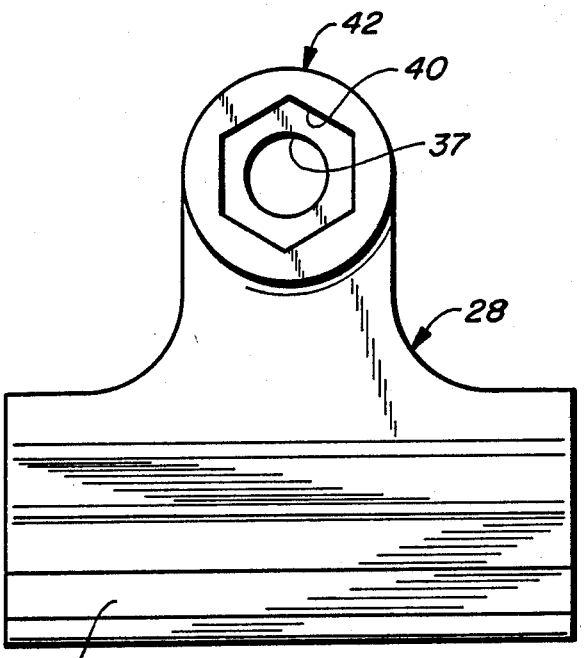
FIG. 5 is a top plan view of another embodiment of the tip holder of this invention.

The present invention is an improved tip holder 28 which can be one piece, as shown in FIG. 4, or it can be split into two tip holders, as shown, for example, in FIGS. 3 or 5, and used in a known manner. References to a singular feature of the tip holder of this invention are intended to include the feature in plural for a single-piece tip holder, when appropriate.

The tip holder 28 of the present invention includes a mounting member portion 29 for removably securing the tip holder to a portion of the rotor 11. The mounting member portion, which is also referred to hereinafter as a mounting member, has an inner mounting surface 31 and an outer mineral-contacting surface 33 and the distance therebetween is its thickness, as can be seen from the drawings. The mounting member has a projection at one end in the form of a step 35 of the tip holder and it has mounting means proximate its other end. The mounting means can include an aperture 37 in the free end of the mounting member for receiving a fastening member 39 which anchors the tip holder to the appropriate portion of the rotor. Usually the mounting member will be anchored to the rotor by means of a bolt 39 threaded into a locking means, such as a nut 41, which is countersunk in the tip carrier plate 23 of the rotor. In the prior art tip holders, the bolt threads frequently become distorted during operation of the rotor and it is then necessary to chip away the rock bank 13 and to insert a tool for holding the head so that the bolt can be released. To overcome this problem, the mounting member of the present invention may also include fastener locking means 40 whereby the tip holder can be released from the rotor with the aid of a tool applied only to the outer end **39*b* of a fastener locked in the mounting member. The fastener locking means restricts the movement of the head 39*a* of the fastener relative to the mounting member and allows the use of other style pins or fasteners to mount the tip holder to the rotor. In one of the embodiments of this invention, the fastener locking means includes a projecting collar portion 42 disposed at the free end of the mounting member on its upper surface and shaped to receive and lock the head 39*a* of a hex bolt, which may be countersunk in the collar. In this embodiment, the bolt head is secured from free movement and the tip holder can be released by using a tool applied only to the outer end 39*b*** of the bolt.

In many rotary mineral breakers, backup tip plates 25 with tungsten inserts 43 will be interposed between the tip holder 28 and the tip carrier plate 23 to provide additional protection to the rotor. The inner surface 31 of the mounting member portion will contact the upper surface of such backup plates. Although for ease of description, a typical rotor setting is described, it is not intended that the use of the tip holder of this invention be limited to any particular rotor configuration, since it can be adapted to mount to the rotor directly or to any mounting flange of the rotor. Although the mounting member 29 may be in the form of a full-size plate, as shown in FIG. 3, the preferred embodiment employs a mounting member portion in the form of a hanger for receiving the bolt, as illustrated in FIG. 4, in which it can be seen that the free end of the mounting member portion has a width across the outer surface 33 which is smaller than the length of the top surface 45 of the step 35. The mounting member of this embodiment uses less material in its construction than conventional tip holders and is therefore lighter and less expensive. It is also less cumbersome and can be released from the rotor more easily than tip holders with the plate-type mounting member because less mineral material needs to be dislodged. Most importantly, however, the mounting member of this embodiment is shaped to allow mineral material to contact the surface underlying the tip holder and the lower inner portion **51*a* of the material retaining surface 51 of the step 35**, which surface is along the thickness of the mounting member portion, as will be seen hereafter. This increased volume of space unexpectedly allows the mineral bank to be more firmly held in place by the tip holder and allows the tip holder to hold larger rocks in the bank of material.

Figure 12:
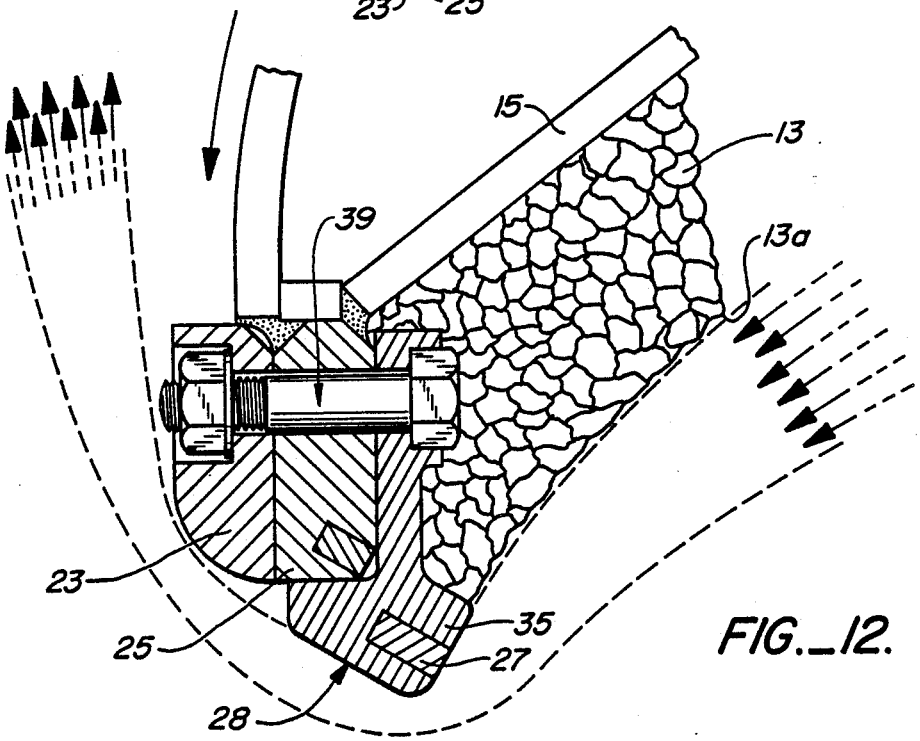
FIG. 12 is a top plan view in partial cross-section of the tip holder shown in FIG. 5 in position in the rotor.

The tip holder 28 of this invention also includes a step 35 connected, to the mounting member 29. This step, which may be integrally formed on one end of the mounting member, has a top surface 45 and a recess 47. The step also has a mineral anchoring portion 49 which is capable of retaining and stabilizing a bank of mineral material in the rotor in which the mineral material may have a diameter of up to 100 mm. The rock wave generally includes rocks having a variety of sizes, depending on the homogeneity of the feed, and it is understood that the tip holder of this invention is capable of providing a positive step to anchor both smaller and larger rocks which may be in the rock bank. The rock bank 13 shown in FIG. 12 is meant to be illustrative only and is not meant to represent a limitation on the size rocks which can be effectively stabilized by the tip holder of this invention. The accepted maximum diameter for the mineral feed of typical rotary mineral breakers using prior art tip holders (in order to prevent premature failure of the tip holder) is approximately 57 mm.

The mineral anchoring portion of the step has a material retaining surface 51, which, as can be seen from FIG. 4, is adjacent to a top surface 45 of the step and oriented toward the mounting member portion 29. The material retaining surface has a length generally coextensive with the length of the top surface. The width of the material retaining surface is approximately equal to or greater than the depth of a first insert 27 of abrasion resistant material placed in recess 47. The depth of the insert 27 is measured from the top surface 45 of the tip holder to the lowest point on the surface 27*a* of the insert. Where there are a plurality of inserts, the depth referred to is the depth of the first insert, that is, the one closest to the top surface of the tip holder. The top surface 45 of the step refers to an abrasion receiving portion of the tip holder where the rock flow strikes the tip holder with the maximum velocity. The step may be perpendicular to the mounting member but it is preferably inclined away from it, the material retaining surface of the step disposed adjacent to the top surface forming an angle of approximately 120° from the plane of the mounting member. In the preferred embodiment, the upper part of the mineral anchoring portion 49 of the step 35 is adapted to be substantially perpendicular to the outer surface 13*a* of the rock wave of mineral material 13 in the rotor. The top surface of the step is adapted to be substantially flush with the outer surface of mineral material immediately adjacent thereto.

The mineral anchoring portion 49 of the step has a material retaining surface 51 which contacts the retained rocks in the bank of material. The upper part of the material retaining surface is substantially perpendicular to the outer surface 13*a* of the mineral bank at the interface of the step and the mineral bank and is inclined away from the mounting member 29. In an embodiment with a solid plate mounting member, such as shown in FIG. 3, the width of the material retaining surface and of the step extends from the top surface 45 of the step to the outer surface 33 of the mounting member. In an embodiment with a mounting member along the entire length of the material retaining surface and this width may be at least as great as the thickness of the mounting member portion such as that shown in FIG. 4, however, the effective width of the material retaining surface includes a lower inner portion 51*a* which is exposed to the rock bank because of the narrow projection of the mounting member from the step. Thus, the width of the material retaining surface along portions of its length would equal to the distance from the top surface 45 of the step to the lower surface 31 of the mounting member 29 and would include the thickness of the mounting member. The increased size of the anchoring portion of the step provides a positive step for anchoring larger size rocks in the rock wave lining the rotor and the orientation of the step allows this rock bank to cover and protect most of the tip holder from excessive wear, thus preventing the step from being worn away, which in extreme cases, causes the inserts to fall out. It has been found that with the step of this invention, premature failure of the tip holder is prevented and the life of the tip holder is extended. Surprisingly, it has also been found that a tip holder with the step of this invention provides more control on the pattern and depth of the rock wave, requiring fewer and less precise adjustments to nonradial plates 17 of the rotor, which in prior art tip holders must usually be fine-tuned to control the mineral pattern. This tip holder allows larger and coarser materials to be processed.

Figure 3A:
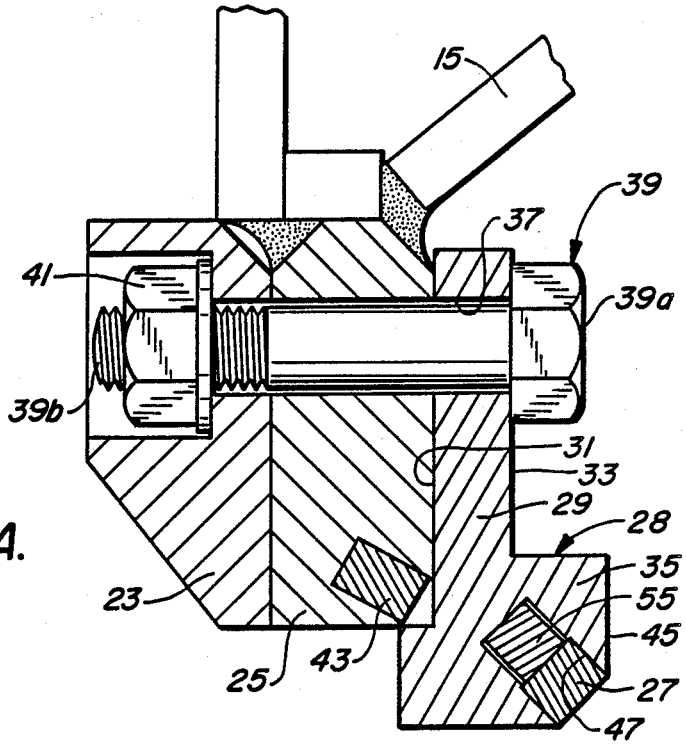
FIG. 3A is a cross-sectional view of the invention shown in FIG. 3.
Figure 4A:
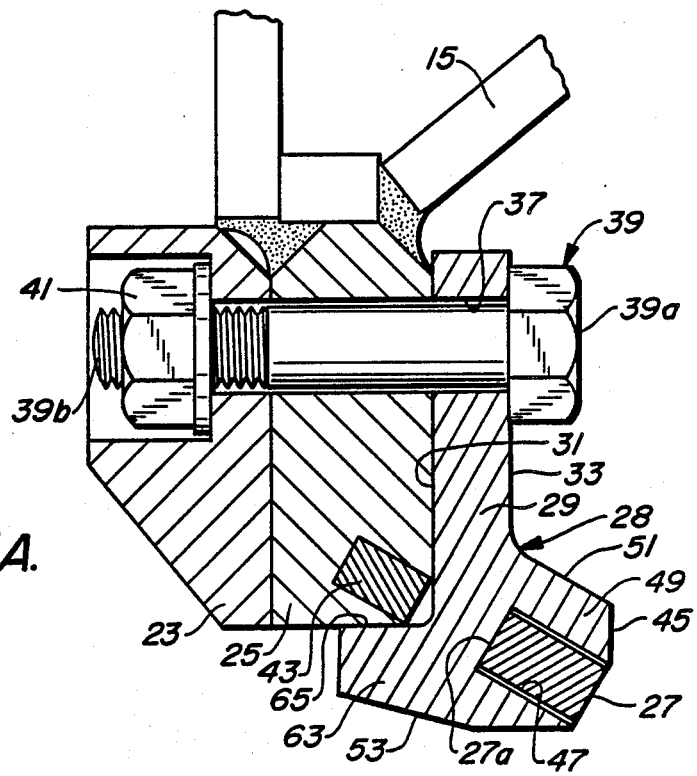
FIG. 4A is a cross-sectional view of the embodiment shown in FIG. 4.

The step 35 of the tip holder 28 has a top surface or major abrasion-receiving portion 45, over which most of the discharged rocks pass at their maximum velocity. This top surface is exposed to contact with the discharging mineral materials across its length. At least one recess 47 is disposed longitudinally in the step proximate this outer edge and an insert 27 of an abrasion resistant material, such as tungsten carbide, is fixed in the recess, by adhesive or the like. As mentioned before, in prior art tip holders, the recess provided is a rectangular groove opening to the surface 45 of the step into which a number of rectangularly-shaped tungsten inserts 27 are inserted in longitudinal series and then bonded to the tip holder by braising. Although the tip holder of the present invention has been found to be significantly more effective than the prior art tip holders, even when the invention uses inserts similar to those of the prior art, it is preferable to use a plurality of inserts arranged longitudinally through the step and parallel to each other. A longitudinal position, in this context, means one along an axis parallel to the top surface 45 of the step. In the tip holder of one preferred embodiment of this invention, the step has at least two substantially parallel recesses, disposed longitudinally through the step, and an insert of abrasion resistant material fixed in each of them. The recesses may be contiguous and the inserts may be rectangular in shape, as shown in FIG. 3A, but for maximum effect there should be at least an air gap separating the pieces of tungsten carbide. This arrangement prevents the failure of the entire tip. Even after the first insert has been damaged and has cracked through to its entire depth, the second insert 55 remains intact and continues to resist the wear of the rock stream. This feature thus extends the life of the tip holder substantially, thereby reducing the labor costs of changing the tips and providing additional backup protection for the rotor.

Figure 6:
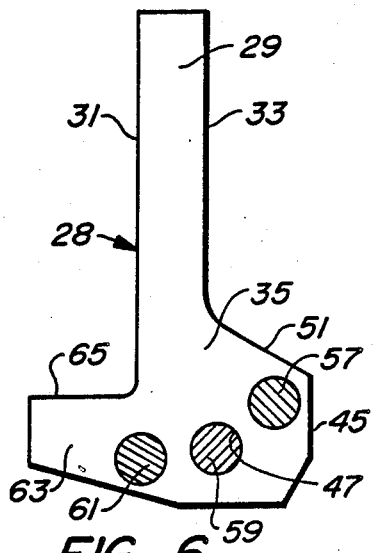
FIGS. 6, 7, 8 and 10 are diagrammatic cross-sectional views of other embodiments of the tip holder of this invention.
Figure 5A:
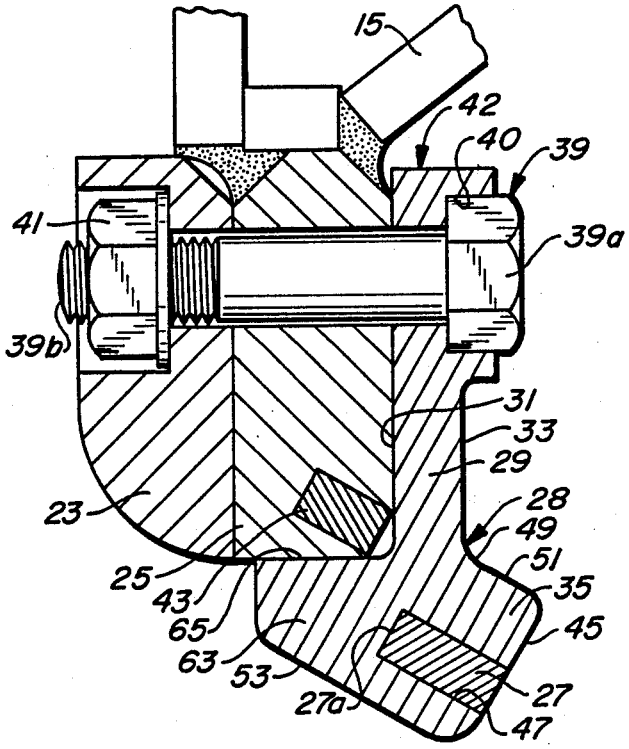
FIG. 5A is a cross-sectional view of the embodiment shown in FIG. 5.
Figure 7:
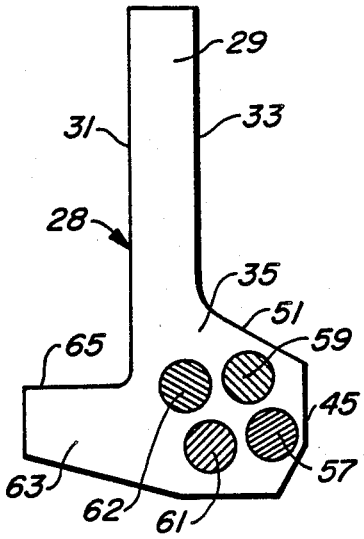
Figure 8:
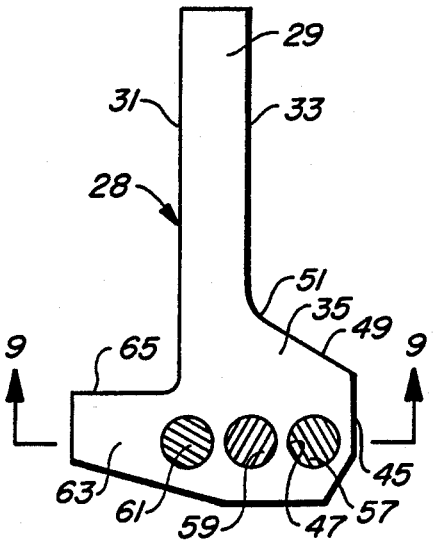
Figure 10:
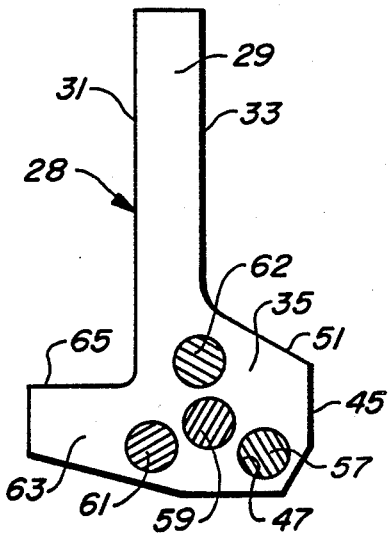
Figure 9:
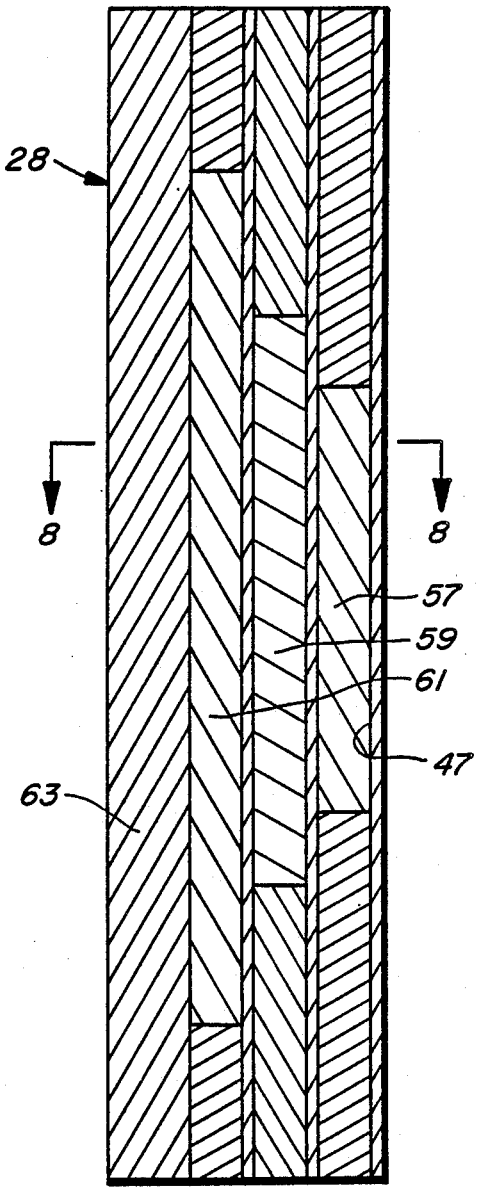
FIG. 9 is a cross-sectional view taken along line 9—9 of FIG. 8.

In another preferred embodiment of the tip holder 28 of this invention the wear resistant inserts are substantially cylindrical and are disposed in said holder in an alignment predetermined to reduce the expected abrasion on the tip holder from specific mineral feeds. The recesses, which are circular in cross-section to conform to the shape of the inserts, are separated from each other, and may be aligned in various patterns, such as those illustrated in FIGS. 6, 7, 8 and 10. The inserts are aligned and sized to protect the abrasion-receiving portions of the shoulder, which vary from one type of feed to another. After the wear pattern of the feedstock on the tip is determined, a tip holder can be made in which inserts of different lengths, selected to avoid scrap loss, are positioned within the step to protect the areas of the greatest exposure. FIG. 9 generally illustrates an orientation of inserts 57, 59, 61 for a holder in which the wear will be the greatest in the center and towards the top surface 45 thereof, but the tip holder can be protected against even specialized wear patterns, as for example in FIGS. 6, 7 and 10. Numerous advantages flow from the use of a plurality of parallel inserts, and particularly circular inserts. Stock circular tungsten carbide inserts can be used, reducing the cost of preparing the tungsten; a variety of lengths can be combined to cover only the expected wear pattern, thus avoiding the wastage of any tungsten. The inserts may be aligned so that the joints of the inserts in one recess are offset to the joints of inserts in an adjacent recess, thus effectively stopping slip streaming, even where inserts are joined. The circular recesses are particularly advantageous to prevent slip streaming since there are no corners formed between the inserts and the support metal of the tip holder and it is more difficult for small particles to travel through the space surrounding the insert. Even as the support metal is worn away the inserts will be retained longer in place without falling out than in conventional tip holders. Thus, there is an "unveiling" of several separate levels of wear resistant material that must be damaged or worn away before the tip holder fails and must be replaced, thereby substantially increasing its useful life in place.

One can determine the preferred dimensions and location for the tungsten inserts for the tip holder by first placing a blank tip holder or one with a conventional insert in the rotor in its normal position whereby mineral material will be passed over an abrasion-receiving portion of the tip holder; operating the rotor with the desired mineral feed and operating conditions until a wear pattern has been imposed on the blank; then creating appropriate parallel recesses in a stock tip holder, positioning such recesses longitudinally in the step of the tip holder in the path of the greatest wear; and placing inserts of abrasion resistant material of a length suitable for the length of the wear pattern in the recesses.

The tip holder 28 of the present invention also includes a flange 63 which depends from the step 35 and is integral thereto. The flange is adapted to contact and protect the underlying portion of the rotor 11 to which it is attached and to support the tip holder in place. In the usual application, the flange depends generally perpendicularly from the mounting member 29 and its inner surface 65 joins the inner surface 31 of the mounting member. In the preferred embodiment the length of the flange, measured along its inner surface, may be approximately equal to the width of the material retaining surface 51 of the step. The flange is integrally formed with the step and the mounting member and is shaped to conform to the shape of the underlying part of the rotor, which in many cases is the backup tip plate, to wrap around and protect it from impact from random rebound material as well as from the slip streaming action of the fine material. The step has an outer surface 53 which is integral with the outer surface of the flange. This outer surface is disposed adjacent to the top surface and on the opposite side thereof from the material retaining surface. This outer surface is shaped to direct the flow of fine particles in the mineral feed away from the underlying rotor surface, as is illustrated in FIG. 12. Thus, when placed into operation, the tip holder of this invention will cause a deep rock bank, including large rocks, to build up in the rotor and form a solid anchor, covering much of the tip holder. Subsequent rocks being discharged from the rotor will pass along the solid rock bank surface and will contact the top surface of the tip holder which is flush with the rock bank and which contains inserts of abrasion resistant material. The larger rocks will be thrown out of the rotor and clear of the tip; finer materials, because of their lower mass, will follow a path in a slip stream action along the outer surface of the step and flange and will exit the rotor tangentially to it without causing serious abrasion to the outer parts of the rotor. The flange is substantial enough to protect the tip holder from deformation due to the bending forces exerted against the step caused by high tonnage operation, thus protecting it, even in a worn condition, from sudden failure due to cracking and deforming of the tip holder.

The tip holder 28 of this invention may be made by casting to increase the variations in configurations available. Openings are then drilled in the casting to fit the desired pattern of insert. The inserts may be fixed in the recesses by any known method, for instance, by adhesive or by the use of epoxy, which will also add shock absorbency to the tungsten carbide. Manufacture of this part by casting allows the tip holder to be made from metal with a controlled hardness and permits the use of circular stock tungsten.

Thus, the present invention provides an improved tip holder having a number of advantageous features which can be employed separately or in combination to increase the life and effectiveness of the tip holder and thereby reduce the frequency and expense of replacement of the tips and the down time of the mineral breaker while replacement occurs.

Thus, the present invention provides a tip holder having an improved mounting member which requires less metal to be used in its manufacture, which increases the access of the rock bank to the anchoring portion of the tip holder, which is easier to use and remove from the rotor because of its special locking means and which still secures the tip holder to the mineral breaker.

The present invention also provides a tip holder having a step which is shaped to stabilize a bank of mineral material, including larger-sized minerals, and to use the retained mineral material to protect the tip holder from failure due to impact forces and excessive wear and to reduce the need for exact adjustment of the rotor. This tip holder also has a flange which helps to secure the tip holder in place, which protects the underlying plate to which the tip holder is anchored, which protects the tip holder from deformation due to bending forces and which directs the flow of fine particles in the mineral feed. The tip holder of this invention also provides a plurality of wear resistant inserts for parallel longitudinal recesses in the step of the tip holder, resulting in specialized and customized backup protection for the rotor. The additional wear resistance of the plural inserts becomes available without interrupting the operation of the mineral breaker to change the tips, thus reducing down time and cost of replacement. The design of this tip holder and the method of predetermining the plural recesses enable one to vary the placement and lengths of the inserts and to tailor the protection of the tungsten insert to the specific mineral feed and to the areas in which it experiences the greatest wear. It allows the maximum use of costly tungsten without wastage. In addition, the tip holder of this invention removes many limitations on the sizes and types of mineral feeds which such rotary mineral breakers can process, making these vertical shaft impactors feasible for a wider range of material. All of these improvements increase the production, efficiency and versatility of the mineral breaker with which the tip holders of this invention are used, extending the life of the tips, reducing the down time, and enhancing the value of the mineral breaker.

It will be seen that the above-described tip holder will achieve all the advantages and objects attributed to it, and while it has been described in detail, it is not to be limited to such details except as may be necessitated by the appended claims.

We claim:

1. An improved tip holder for the rotor of a centrifugal mineral breaker having discharge ports through which mineral material is passed out of said rotor, the tip holder comprising a projecting mounting member portion for removably securing said tip holder to a rotor of a centrifugal mineral breaker proximate a discharge port thereof, said mounting member portion having an inner mounting surface and an outer mineral-contacting surface, the distance therebetween being the thickness of said mounting member portion;

a step integrally formed on one end of said mounting member portion and projecting therefrom into the path of the mineral material stream being passed out of said rotor, said step having a top surface for contacting said discharging mineral material, said step forming at least a portion of a material retaining surface disposed adjacent to said top surface and oriented toward said mounting member portion, said material retaining surface being formed for retaining a built-up bank of mineral materials extracted from the stream of mineral materials being passed out of said rotor, said material retaining surface being capable of retaining and stabilizing in said bank mineral materials having diameters of varying sizes up to 100 mm., said step also having at least one recess formed longitudinally therethrough;

an insert of abrasion resistant material at least partially enclosed in each recess of said step; and a supporting and mineral flow-directing flange depending from the step in the general direction of the flow of discharged material.

2. The improved tip holder of claim 1 wherein the material retaining surface has a width for at least a portion of its length which is at least as great as the depth of the insert of abrasion resistant material disposed in said step closest to the top surface thereof.

3. The improved tip holder of claim 1 wherein the width of said material retaining surface is at least as great as the thickness of said mounting member portion.

4. The improved tip holder of claim 1 wherein the material retaining surface of said step includes a portion disposed substantially perpendicular to the mineral flow occurring closest to the surface layer of a retained bank of mineral material at the interface of the step and the mineral bank.

5. The improved tip holder of claim 1, 2 or 3 wherein the material retaining surface disposed adjacent to the top surface of said step is disposed at an angle of at least 90° from the plane of the outer surface of the mounting member portion.

6. The improved tip holder of claim 1, 2 or 3 wherein the mounting member portion has an aperture for receiving a fastening member and a surface of said mounting member portion proximate said step is shaped to permit mineral material to be retained against said surface, said surface including the thickness of said mounting member portion.

7. The improved tip holder of claim 6 wherein the mounting member portion further comprises fastener locking means having a fastening member with one end for engaging the mounting member portion and the other end for securing said tip holder to a mount whereby said tip holder can be released from said mount with the aid of a top applied only to the other end of said fastening member.

8. The improved tip holder of claim 6 wherein the mounting member portion is formed to permit rocks in the bank of retained minerals to contact the underlying mounting surface to which the tip holder is secured.

9. The improved tip holder of claim 1 wherein said step has an outer surface adjacent to said top surface on the opposite side thereof from said material retaining surface and shaped to direct the flow of fine particles in the mineral material stream being passed out of said rotor away from any other portion of said rotor, and the top surface of said step is formed to be substantially coplanar with the surface level of a retained bank of mineral material disposed immediately adjacent thereto.

10. The improved tip holder of claim 1 or 9 wherein the supporting and mineral flow-directing flange is integral to said step and projects generally at a right angle away from said mounting member portion.

11. The tip holder of claim 1 wherein a plurality of inserts of abrasion resistant material are disposed longitudinally through said step in substantially parallel relationship.

12. The tip holder of claim 11 wherein said inserts are cylindrical and are disposed in said holder in separated recesses in said step in a predetermined alignment to reduce the effect of abrasion on said tip holder from specific mineral feeds.

13. An improved tip holder for the rotor of a centrifugal mineral breaker having discharge ports through which mineral material is passed out of the rotor, the tip holder comprising at least one mounting member portion for removably securing said tip holder to a rotor of a centrifugal mineral breaker proximate a discharge port thereof, said mounting member portion having an inner mounting surface and an outer mineral-contacting surface, the distance therebetween being the thickness of the mounting member portion, and mounting means proximate one end;

a step integrally formed on the other end of said mounting member portion and projecting transversely therefrom into the path of mineral material being passed out of said rotor, said step having a top surface formed to be substantially coplanar with the surface layer of a retained bank of mineral material immediately adjacent thereto, an outer surface disposed adjacent to said to surface and shaped to direct the flow of fine particles in the mineral material stream away from said rotor, and a material retaining surface disposed adjacent said top surface and said mounting member portion, said material retaining surface formed for retaining a built-up bank of mineral materials, the width of a portion of said material retaining surface being approximately equal to the distance from the top surface of the step to the inner mounting surface of the mounting member portion, said step also comprising at least one recess formed longitudinally therethrough;

an insert of abrasion resistant material fixed in each recess of said step;

said material retaining surface having a width for a portion of its length which is at least as great as the depth of the insert of abrasion resistant material disposed closest to the top surface of said step; and a stabilizing and mineral flow-directing flange depending from the step and formed to direct the flow of discharge material.

14. The improved tip holder of claim 13 wherein the mounting member portion is formed to permit rocks in the bank of retained mineral materials to contact the underlying mounting surface to which the tip holder is secured.

15. The improved tip holder of claim 14 wherein the material retaining surface disposed adjacent to the top surface of the step is disposed at an angle of approximately 120° from the plane of the outer surface of the mounting member portion.

16. The improved tip holder of claim 14 wherein the mounting means comprises a fastening member and an aperture disposed in said mounting member portion for receiving said fastening member, said mounting member portion also having a collar projecting from its outer surface and shaped to lock the head of the fastening member, said fastening member having one end for engaging said collar and another end for securing said tip holder to a mount disposed proximate an exterior surface of the rotor with a locking means whereby the tip holder can be released from a rotor with the aid of a tool applied only to the locking means.

17. The improved tip holder of claim 13 wherein the mounting member portion has a free end in the form of a projection extending from the step, said mounting member portion having an aperture in said free end for receiving a fastening member, said free end having a width across the outer surface thereof which is smaller than the length of the top surface of said step whereby the material retaining surface includes a portion of the thickness of the mounting member portion.

18. An improved tip holder for the rotor of a centrifugal mineral breaker having discharge ports through which mineral material is passed out of the rotor, the tip holder comprising at least one mounting member portion for removably securing said tip holder to a rotor of a centrifugal mineral breaker proximate a discharge port thereof, said mounting member portion having an inner mounting surface and an outer mineral-contacting surface, the distance therebetween being the thickness of said mounting member portion;

a step integrally formed on one end of said mounting member portion and projecting therefrom into the path of the mineral material stream being passed out of said rotor, said step having a top surface for contacting said discharging mineral material substantially across the length of said top surface, said step forming at least a portion of a material retaining surface disposed adjacent to said top surface of said step, at least a portion of the thickness of said mounting member portion also forming a portion of the material retaining surface, said material retaining surface being formed for retaining a built-up bank of mineral materials extracted from the stream of mineral materials being passed out of said rotor, said step also having at least one recess formed longitudinally therethrough;

an insert of abrasion resistant material disposed in each recess of said step; and a supporting and mineral flow-directing flange depending from said step in the general direction of the flow of discharged material.

19. The improved tip holder of claim 18 wherein the supporting and mineral flow-directing flange is integral to said step and projects generally at a right angle away from said mounting member portion, said flange being formed to protect the underlying surface of a rotor in contact with said flange from erosion.

20. The tip holder of claim 18 wherein a plurality of inserts of abrasion resistant material are disposed longitudinally in said step in substantially parallel relationship.

21. The tip holder of claim 20 wherein said inserts are cylindrical and are disposed in said holder in separated recesses in a predetermined alignment to reduce the effect of abrasion on said tip holder from specific mineral feeds.

22. The improved tip holder of claim 18 wherein the inner surface of the supporting and mineral flow-directing flange has a length approximately equal to the width of the material retaining surface of the step.

23. An improved tip holder for the rotor of a centrifugal mineral breaker having discharge ports through which mineral fastening member.

24. The improved tip holder of claim 18 or 23 wherein the width of the material retaining surface for at least a portion of its length is at least as great as the thickness of the mounting member portion.

25. An improved tip holder for the rotor of a centrifugal mineral breaker having discharge ports through which mineral material is passed out of the rotor, the tip holder comprising at least one mounting member portion for removably securing said tip holder to a rotor of a centrifugal mineral breaker proximate a discharge port thereof, said mounting member portion having an inner mounting surface and an outer mineral-contacting surface, the distance therebetween being the thickness of said mounting member portion;

a step integrally formed on one end of said mounting member portion and projecting therefrom into the path of the mineral material stream being passed out of said rotor, said step having a top surface for contact said discharging mineral material substantially across the length of said top surface, said step having a width measured from the outer mineral-contacting surface of the mounting member portion to the top surface of the step and forming a material retaining surface disposed adjacent to said top surface of said step, the width of said material retaining surface for at least a portion of its length being at least as great as the thickness of the mounting member portion, said material retaining surface being formed for retaining and stabilizing a built-up bank of mineral materials extracted from the stream of mineral materials being passed out of said rotor, said step also having at least one recess formed longitudinally therethrough;

an insert of abrasion resistant material disposed in each recess of said step; and a supporting and mineral flow-directing flange depending from said step in the general direction of the flow of discharged material.

26. The improved tip holder of claim 39, 23 or 25 wherein the mounting member portion has a free end in the form of a projection extending from the step, said mounting member portion having an aperture in said free end for receiving a fastening member, said free end having a width across the outer surface thereof which is smaller than the length of the top surface of said step whereby the material retaining surface includes a portion of the thickness of the mounting member portion.

27. The improved tip holder of claim 26 wherein the mounting member portion further comprises fastener locking means having a fastening member with one end for engaging the mounting member portion and the other end for securing said tip holder to a mount whereby said tip holder can be released from said mount with the aid of a top applied only to the other end of said fastening member.

28. The improved tip holder of claim 18 or 25 wherein the material retaining surface has a width for at least a portion of its length which is at least as great as the depth of the insert of abrasion resistant material disposed in said step closest to the to surface thereof, the depth of said insert being measured from the top surface of the tip holder to the lowest point on the surface of said insert farthest from said top surface.

29. The improved tip holder of claim 18, 23 or 25 wherein the mounting member portion is formed to permit rocks in the bank of retained minerals to contact the underlying mounting surface to which the tip holder is secured.

30. The improved tip holder of claim 18, 23 or 25 wherein the material retaining surface of said step includes a portion disposed substantially perpendicular to the mineral flow occurring closest to the surface layer of a retained bank of mineral material at the interface of the step and the mineral bank.

31. The improved tip holder of claim 18, 23 or 25 wherein the material retaining surface disposed adjacent to the top surface of said step is disposed at an angle of at least 90° from the plane of the outer surface of the mounting member portion.

* * * * *

UNITED STATES PATENT AND TRADEMARK OFFICE
CERTIFICATE OF CORRECTION

PATENT NO. 4,940,188

DATED July 10, 1990

INVENTOR(S) John Rodriguez and Damian Rodriguez

It is certified that error appears in the above—identified patent and that said Letters Patent is hereby corrected as shown below:

Col. 7, line 44, cancel ". In an embodiment with a mounting member" and insert in line 48, after "mounting member", --. In an embodiment with a mounting member--; Col. 7, line 54, after "would", insert --be--.

In the claims, Claim 7, col. 11, line 67, "top" should read --tool--.

Claim 13, col. 12, line 47, "to" should read --top--; in line 68, "discharge" should read --discharged--.

Claim 23, col. 14, line 18, after "mineral", cancel "fastening member" and insert --material is passed out of the rotor, the tip holder comprising at least one mounting member portion for removably securing said tip holder to a rotor of a centrifugal mineral breaker proximate a discharge port thereof, said mounting member portion having an inner mounting surface and an outer mineral-contacting surface, the distance therebetween being the thickness of said mounting member portion;

a step integrally formed on one end of said mounting member portion and projecting therefrom into the path of the mineral material stream being passed out of said rotor, said step having a top surface for contacting said discharging mineral material substantially across the length of said top surface, said step forming at least a portion of a material retaining surface disposed adjacent to said top surface of said step, said material retaining surface being formed for stabilizing and retaining a built-up bank of mineral materials extracted from the stream of mineral materials being passed out of said rotor, said step also having at least one recess formed longitudinally therethrough;

an insert of abrasion resistant material disposed in each recess of said step, said insert having a depth measured from the top surface of said tip

UNITED STATES PATENT AND TRADEMARK OFFICE

CERTIFICATE OF CORRECTION

PATENT NO. : 4,940,188

DATED : July 10, 1990

INVENTOR(S) : John Rodriguez and Damian Rodriguez

It is certified that error appears in the above—identified patent and that said Letters Patent is hereby corrected as shown below:

holder to the lowest point on the surface of said insert farthest from said top surface;

a supporting and mineral flow-directing flange depending from said step in the general direction of the flow of discharged material; and said material retaining surface having a width for at least a portion of its length which is at least as great as the depth of the insert of abrasion resistant material disposed in said step closest to the top surface thereof.--

Claim 25, col. 14, line 38, "contact" should read --contacting--.

Claim 26, col. 14, line 58, "39" should read --18--.

Claim 27, col. 15, line 5, "top" should read --tool--.

Claim 38, col. 15, line 11, "to" should read --top--.

Signed and Sealed this

Twenty-sixth Day of November, 1991

*Attest:*

HARRY F. MANBECK, JR.

*Attesting Officer*

*Commissioner of Patents and Trademarks*